US009837742B2

(12) United States Patent
Lee et al.

(10) Patent No.: US 9,837,742 B2
(45) Date of Patent: Dec. 5, 2017

(54) PIN STRUCTURE AND CONNECTOR INCLUDING PIN STRUCTURE

(71) Applicant: Samsung Display Co., Ltd., Yongin, Gyeonggi-Do (KR)

(72) Inventors: Dae-Sik Lee, Asan-si (KR); Jin-Won Jang, Asan-si (KR)

(73) Assignee: Samsung Display Co., Ltd. (KR)

( * ) Notice: Subject to any disclaimer, the term of this patent is extended or adjusted under 35 U.S.C. 154(b) by 197 days.

(21) Appl. No.: 14/749,196

(22) Filed: Jun. 24, 2015

(65) Prior Publication Data

US 2016/0248183 A1 Aug. 25, 2016

(30) Foreign Application Priority Data

Feb. 25, 2015 (KR) ..... 10-2015-0026803

(51) Int. Cl.
*H01R 12/70* (2011.01)
*H01R 13/05* (2006.01)
*H01R 12/55* (2011.01)

(52) U.S. Cl.
CPC ..... *H01R 13/05* (2013.01); *H01R 12/55* (2013.01)

(58) Field of Classification Search
CPC ..... H01R 12/7076; H01R 12/7005; H01R 13/05; H01R 12/55
USPC ..... 439/78, 59, 83, 567, 751, 342, 590
See application file for complete search history.

(56) References Cited

U.S. PATENT DOCUMENTS 6,340,318 B1 * 1/2002 Wright ..... H01R 12/585 439/751
6,425,771 B1 * 7/2002 Shirai ..... H01R 13/193 439/342
7,744,408 B2 * 6/2010 Komatsu ..... H05K 3/308 439/567
2006/0240684 A1 * 10/2006 Chang ..... B23K 1/0016 439/59

FOREIGN PATENT DOCUMENTS

KR 10-2001-0047390 A 6/2001
KR 10-2012-0129231 A 11/2012
KR 10-2014-0052239 A 5/2014

* cited by examiner

*Primary Examiner* — Edwin A. Leon
(74) *Attorney, Agent, or Firm* — Innovation Counsel LLP

(57) ABSTRACT

A pin structure may be connected to a printed circuit board (PCB), and may include a circuit connection portion connected to a circuit component, a variable portion, and a PCB connection portion. The variable portion may be connected to the circuit connection portion and may be configured to deform in shape when the PCB is bent. The PCB connection portion is connected to the variable portion and connected to the PCB.

14 Claims, 20 Drawing Sheets

PIN STRUCTURE AND CONNECTOR INCLUDING PIN STRUCTURE

RELATED APPLICATIONS

This application claims priority to and the benefit of Korean Patent Application No. 10-2015-0026803 filed in the Korean Intellectual Property Office on Feb. 25, 2015, the entire contents of which are incorporated herein by reference.

BACKGROUND

1. Field

The described technology relates generally to a pin structure, and more particularly, to a pin structure, and a connector including the pin structure.

2. Description of the Related Art

Flat panel display devices are generally light in weight, thin, and operated with less electric power consumption than display devices that use a traditional cathode ray tube (CRT). As a result, flat panel display devices have become widely popular.

Typically, the flat panel display device is classified into a light-emitting type flat panel display device, and a light-receiving type (non-light-emitting type) flat panel display device. Light-emitting type display devices include, for example, an organic light emitting display device (OLED), a plasma display panel (PDP), a flat cathode ray tube (FCRT), a vacuum fluorescent display (VFD) panel, a light emitting diode (LED) panel, or a field emission display (FED). Light-receiving type display devices include, for example, a liquid crystal display (LCD) panel or the like.

Recently, researches and developments are being conducted on a flexible display device, as a next generation display device, that is portable and can be applied to devices having various shapes.

In the flexible display device, a support apparatus may be used so that a user can conveniently see an image while the flexible display device is unfolded or curved, or so that the user can conveniently carry the flexible display device.

The liquid crystal display (LCD) device displays motion pictures by using a thin film transistor as a switching element, and is applied to portable information devices, office devices, computers, televisions, and the like.

Because the liquid crystal display device is not a self-luminous device, a backlight unit is provided at a lower side of a liquid crystal display panel, and the liquid crystal display device displays images by using light emitted from the backlight unit.

The backlight unit may be classified as an edge type backlight unit and a direct type backlight unit based on how its light source is arranged.

In the case of the edge type backlight unit, a light source is disposed at a lateral side of a light guide plate provided at the lower side of the liquid crystal display panel. Light emitted from the light source through the light guide plate is converted into flat light for illuminating the liquid crystal display panel (not illustrated). The edge type backlight unit generally has a reduced thickness, thereby allowing the liquid crystal display device to be made slim.

As the light source of the aforementioned edge type backlight unit, an external electrode fluorescent lamp (EEFL), a cold cathode fluorescent lamp (CCFL), a light emitting diode (LED), and the like may be used, and particularly, in the case of a small liquid crystal display device, the light emitting diode (LED) is widely used.

As an example, the light emitting diode (LED) and a connector is mounted on a light emitting diode (LED) printed circuit board (PCB) (or an LED PCB) on which various types of circuits are formed, and the circuits of the LED PCB and external devices are connected to each other by cables.

Recently, a flexible cable, such as a flexible printed circuit (FPC) and a flexible flat cable (FFC), is used to connect to the connector instead of a wire.

The above information disclosed in this Background section is only for enhancement of understanding of the background of the described technology and therefore may contain information that does not form the prior art that is already known in this country to a person of ordinary skill in the art.

SUMMARY

The described technology has been made in an effort to provide a pin structure that may be used for a variable electronic product, may be deformed in shape, or may be changed in position, and a connector including the pin structure.

An exemplary embodiment provides a pin structure that is connected to a printed circuit board (PCB), the pin structure including: a circuit connection portion connected to a circuit component; a variable portion connected to the circuit connection portion and configured to deform in shape when the PCB is bent; and a PCB connection portion connected to the variable portion and connected to the PCB.

The circuit connection portion may further include a locking unit that prevents the circuit connection portion from being deformed in length when the PCB is bent.

When the circuit connection portion has a rod shape, the locking unit may be a rod portion that is formed at a lower side of the circuit connection portion and has a cross section that has a circumferential length shorter than a circumferential length of a cross section of an upper portion of the circuit connection portion.

The variable portion may have a rod structure that is configured to deform in shape. When the pin structure has a horizontal pin structure, the variable portion may have a zigzag shape or a spring shape. When the pin structure has a vertical pin structure, the variable portion may have a serrated shape, an antenna shape, or a spring shape.

Another exemplary embodiment provides a connector that is connected to a printed circuit board (PCB), the connector including: a connector body; at least one pin inserted into a through hole formed at a lower side of the connector body; and a space providing portion formed between the connector body and the PCB, in which the pin includes: a circuit connection portion inserted into the through hole and connected to a circuit component; a variable portion connected to the circuit connection portion and configured to deform in shape when the PCB is bent; and a PCB connection portion connected to the variable portion and connected to the PCB, and the space providing portion provides a space in which the variable portion is disposed.

When the circuit connection portion further includes a locking unit that prevents the circuit connection portion from being deformed in length when the PCB is bent, the locking unit may be inserted into the through hole.

The variable portion may have a rod structure that is configured to deform in shape. The variable portion may have a serrated shape, an antenna shape, or a spring shape.

Another exemplary embodiment provides a connector that is connected to a printed circuit board (PCB), the connector including: a connector body; and at least one pin inserted into a through hole formed at a side of the connector body, in which the pin includes: a circuit connection portion inserted into the through hole and connected to a circuit component; a variable portion connected to the circuit connection portion and configured to deform in shape when the PCB is bent; and a PCB connection portion connected to the variable portion and connected to the PCB.

When the circuit connection portion further includes a locking unit that prevents the circuit connection portion from being deformed in length when the PCB is bent, the locking unit may be inserted into the through hole.

The variable portion may have a rod structure that is configured to deform in shape. The variable portion may have a zigzag shape or a spring shape.

Another exemplary embodiment provides a connector that is connected to a printed circuit board (PCB), the connector including: a connector body; a pin inserted into any one of at least two insertion holes formed at a side of the connector body; and a connecting hole that is configured to allow the pin to move between the at least two insertion holes when the PCB is bent, and connects the insertion holes.

The pin may include: a circuit connection portion is inserted into any one of the insertion holes and connected to a circuit component; a variable portion connected to the circuit connection portion and configured to deform in shape when the PCB is bent; and a PCB connection portion connected to the variable portion and connected to the PCB.

The variable portion may have a rod structure that is configured to deform in shape.

According to the aforementioned exemplary embodiment, the pin structure and the connector including the pin structure prevent solder cracks when the PCB is bent in electronic products such as a curved display device or a bendable display device, thereby improving reliability of the electronic products.

In addition, the pin structure and the connector including the pin structure according to the present system and method maintain the arrangement of the pins when the PCB is bent in a curved display device or a bendable display device, thereby improving contact reliability of the connector.

BRIEF DESCRIPTION OF THE DRAWINGS

A brief description of the drawings is provided to more sufficiently understand the drawings used for the detailed description of the present system and method.

DETAILED DESCRIPTION

Figure 1:
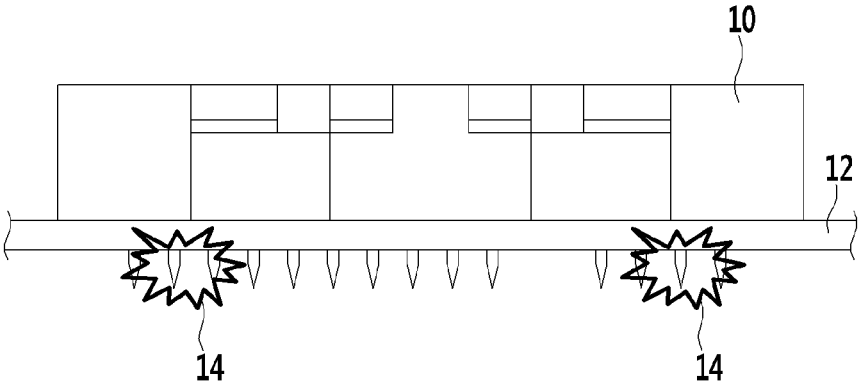
FIG. 1 is a view (longitudinal cross-sectional view) explaining an example of a connector having a vertical pin structure.

References are made to the accompanying drawings for illustrating the exemplary embodiments and contents disclosed herein.

Hereinafter, exemplary embodiments are described in detail with reference to the accompanying drawings. In the description of the present system and method, the specific descriptions of publicly known related configurations or functions thereof are omitted when it is determined that the specific descriptions unnecessarily obscure the subject matter of the present system and method. Like reference numerals may refer to the same or corresponding constituent elements illustrated in the respective drawings.

Terms used in the present specification are used only to describe specific exemplary embodiments, and are not intended to limit the present system and method. Singular expressions used herein include plurals expressions unless they have definitely opposite meanings in the context. In the present specification, terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance.

Throughout this specification and the claims, when a constituent element is referred to as being "directly connected to" another constituent element, the constituent element may be directly connected to the other constituent element or "electrically or mechanically connected to" the other constituent element with other constituent elements therebetween.

All terms used herein, including technical or scientific terms, have the same meanings as meanings that are generally understood by those skilled in the technical field to which the present system and method pertain unless they are differently defined. Terms, including those defined in a generally used dictionary, shall be construed to have meanings matching those in the context of a related art, and shall not be construed in ideal or excessively formal meanings unless they are clearly defined in the present specification.

Recently, electronic products such as a curved display device or a flexible display device are commercialized. Most of the electronic circuit components included in the electronic products are designed to be flat.

FIG. 1 is a view (longitudinal cross-sectional view) explaining an example of a connector having a vertical pin structure.

Referring to FIG. 1, an electronic circuit component includes a circuit component that has a flat structure and is inserted into a connector 10, and a PCB 12 that is connected with the circuit component through a vertical pin structure of the connector 10.

For example, to make a shape of a curved display device, force is applied to both sides of the PCB 12 to which the connector 10 having the vertical pin structure is attached. As a result, the PCB 12 is bent, stress is applied to the solder that connects the pins and the PCB 12, and solder cracks 14 occur in the solder.

Figure 2:
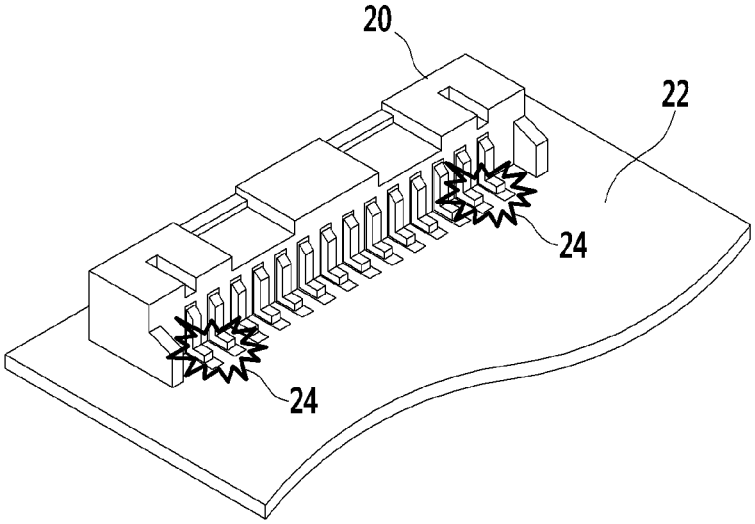
FIG. 2 is a view (perspective view) explaining an example of a connector having a horizontal pin structure.

FIG. 2 is a view (perspective view) explaining an example of a connector having a horizontal pin structure.

Referring to FIG. 2, an electronic circuit component includes a circuit component that has a flat structure and is inserted into a connector 20, and a PCB 22 that is connected with the circuit component through a horizontal pin structure of the connector 20.

For example, to make a shape of a curved display device, force is applied to both sides of the PCB 22 to which the connector 20 having the horizontal pin structure is attached. As a result, the PCB 22 is bent, stress is applied to the solder that connects the pins and the PCB 22, and solder cracks 24 occur in the solder.

Figure 3:
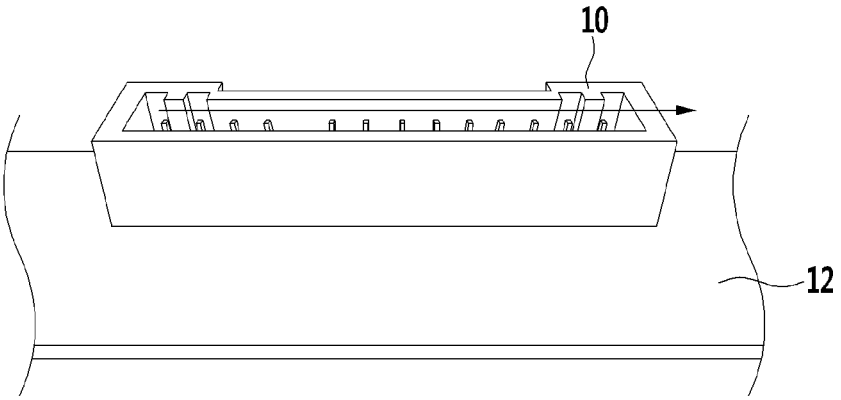
FIG. 3 is a view (perspective view) illustrating an electronic circuit component including the connector illustrated in FIG. 1.

FIG. 3 is a view (perspective view) illustrating an electronic circuit component including the connector illustrated in FIG. 1.

Referring to FIG. 3, in a flat electronic circuit component, pins of the connector 10 disposed on the PCB 12 are disposed in a line.

Figure 4:
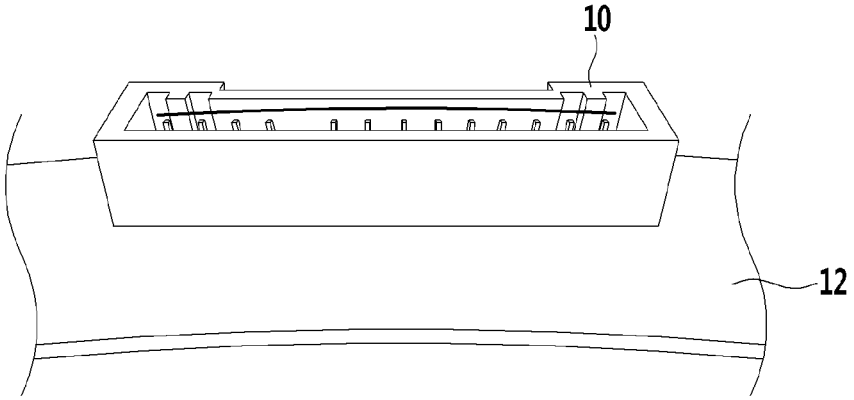
FIG. 4 is a view (perspective view) illustrating a state in which the electronic circuit component including the connector illustrated in FIG. 3 is bent.
Figure 5:
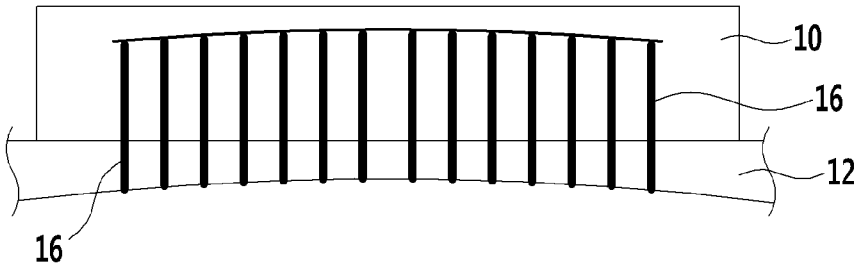
FIG. 5 is a view explaining an arrangement of pins included in the connector in FIG. 4.

FIG. 4 is a view (perspective view) illustrating a state in which the electronic circuit component including the connector illustrated in FIG. 3 is bent. FIG. 5 is a view explaining an arrangement of pins included in the connector in FIG. 4.

Referring to FIGS. 4 and 5, in a case in which the PCB 12 of the electronic circuit component illustrated in FIG. 3 is bent to form a curved electronic circuit component, the connector 10 is also bent. As a result, the ends of the pins 16 are shifted and no longer aligned coplanar to each other, which may cause a contact defect of the connector 10.

In more detail, as illustrated in FIG. 1, 2, or 4, in a case in which the flat circuit component is bent, reliability of the circuit component deteriorates due to the presence of the solder cracks. In addition, as illustrated in FIG. 5, the arrangement of the contact pins of the connector 10 is deformed, which may cause a contact defect of the connector 10. That is, in a case in which the PCB 12 is bent, the upper ends of the pins 16 disposed at an edge portion of the connector 10 and connected to the circuit component are not aligned evenly with each other, and the reach of some of the pins be shorter than that of other pins. As a result, contact reliability of the connector 10 may deteriorate.

The aforementioned problem may be present not only at the connector, but also at the electronic circuit component having a large size.

Figure 6:
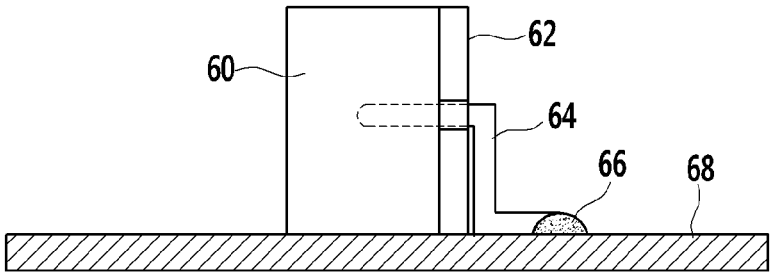
FIG. 6 is a view (longitudinal cross-sectional view) illustrating another example of the electronic circuit component including the connector.

FIG. 6 is a view (longitudinal cross-sectional view) illustrating another example of the electronic circuit component including the connector. FIG. 6 may correspond to the electronic circuit component including the connector illustrated in FIG. 2.

Figure 7:
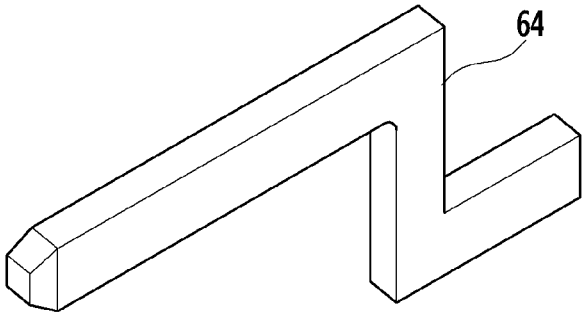
FIG. 7 is a view (perspective view) illustrating the pin structure illustrated in FIG. 6.

Referring to FIG. 6, the electronic circuit component has a circuit component 60 mounted on a PCB 68. The circuit component 60 is inserted into a horizontal pin structure 64 attached to a main body 62 of the connector, and connected to the PCB 68. The horizontal pin structure 64 connects the circuit component 60 and the PCB 68 by solder 66. A shape of the horizontal pin structure 64 is illustrated in FIG. 7. The shape of the horizontal pin structure 64 is not deformed when the PCB 68 is bent.

Figure 8:
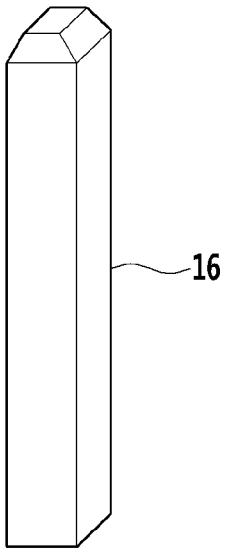
FIG. 8 is a view (perspective view) illustrating the vertical pin structure used for the connector illustrated in FIG. 1.

FIG. 8 is a view (perspective view) illustrating a shape of a vertical pin 16 used for the connector illustrated in FIG. 1. The shape of the vertical pin 16 is not deformed when the PCB 12 is bent.

Figure 9:
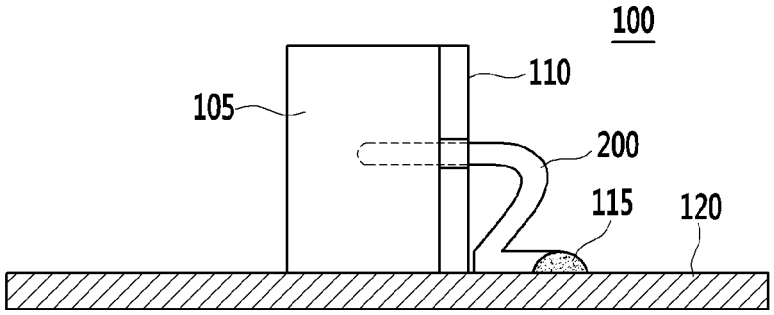
FIG. 9 is a view (longitudinal cross-sectional view) explaining a connector including a pin structure according to an exemplary embodiment.

FIG. 9 is a view (longitudinal cross-sectional view or cross-sectional side view) explaining the connector including a pin structure according to an exemplary embodiment.

Referring to FIG. 9, an electronic device (or electronic component) 100 may include a circuit component 105 mounted on a PCB 120, a connector 110, a connection member 115, such as solder, and the PCB 120. The connector 110 may include at least one pin structure 200. The pin structure 200 may be inserted into a through hole formed at a side of the connector 110. The connector 110 may be applied to (and used for) electronic products such as a curved display device (e.g., a curved liquid crystal display (LCD) device) having a curved or flexible product structure. The pin structure 200 may be connected to a circuit pattern on the PCB (printed circuit board) 120 by the connection member 115.

Figure 10:
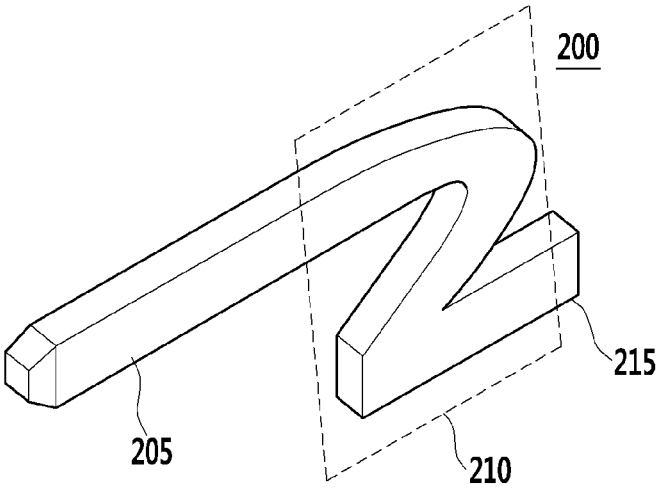
FIG. 10 is a view (perspective view) explaining the exemplary embodiment of the pin structure illustrated in FIG. 9.

FIG. 10 is a view (perspective view) explaining the exemplary embodiment of the pin structure illustrated in FIG. 9.

Referring to FIG. 10, the pin structure 200 of the connector 110 may include a circuit connection portion 205, a variable portion 210, and a PCB connection portion 215.

The circuit connection portion 205 may be electrically connected to (or inserted into) a connecting terminal (external connecting terminal) of the circuit component 105 such as an electronic circuit component. The variable portion 210 may be connected to the circuit connection portion 205, and a shape (or form) of the variable portion 210 may be deformed, unlike the horizontal pin 64 in FIG. 7, when the PCB 120 is bent. The PCB connection portion 215 may be connected to the variable portion 210, and connected to the PCB 120. The variable portion 210 may have a rod structure that is relatively extendable in length, or a rod structure that includes a material that is extendable in length, so that the shape of the variable portion 210 may be deformed when the PCB 120 is bent. In more detail, the variable portion 210 may have a rod structure that deforms in shape while a length (or shape) of the rod structure contracts or expands.

The shape of the pin structure 200 may be formed by a mold. The pin structure 200 may be made of various types of metal having conductivity. For example, the metal may be copper, silver, or aluminum.

In a case in which the connector 110 is a horizontal connector (or the pin structure 200 has a horizontal pin structure), the variable portion 210 may have a rod structure with a zigzag shape (a bent "Z" shape or the number "2" shape) when viewed in a front direction, as illustrated in FIG. 10. For example, as illustrated in FIG. 10, the circuit connection portion 205 and the PCB connection portion 215 may also have a rod structure.

Figure 11:
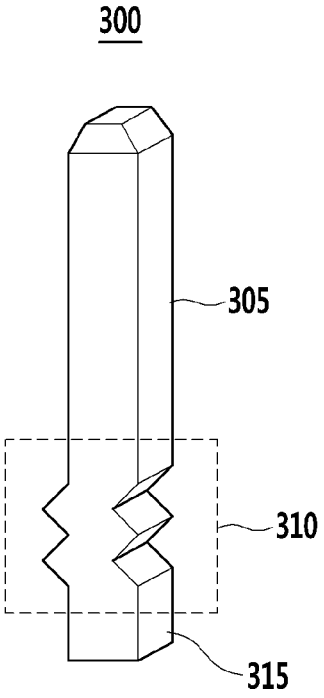
FIG. 11 is a view (perspective view) explaining a vertical pin structure included in the connector according to an exemplary embodiment.

FIG. 11 is a view (perspective view) explaining a vertical pin structure included in the connector according to an exemplary embodiment. A vertical pin structure 300 may be used for (or included in) a connector 515 illustrated in FIG. 15.

Figure 15:
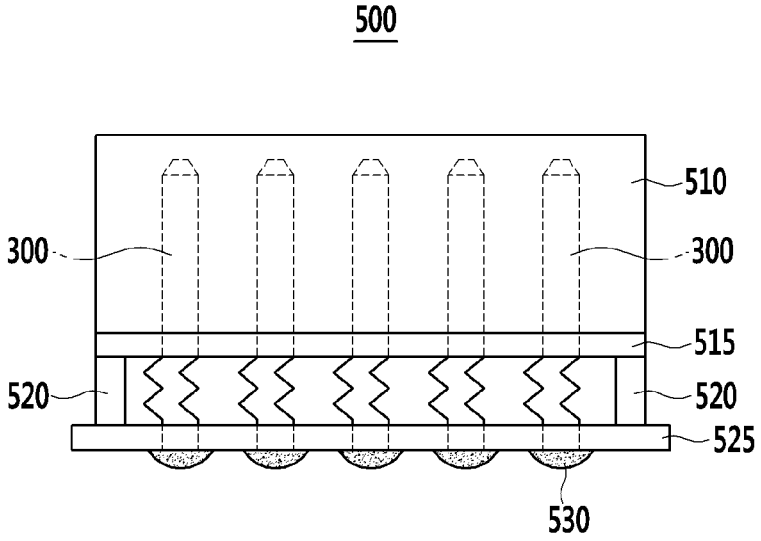
FIG. 15 is a view (longitudinal cross-sectional view) explaining a connector including a vertical pin structure according to another exemplary embodiment.

Referring to FIGS. 11 and 15, the pin structure 300 of the connector 515 may include a circuit connection portion 305, a variable portion 310, and a PCB connection portion 315.

The circuit connection portion 305 may be electrically connected to (or inserted into) a connecting terminal of a circuit component 510 (FIG. 15) such as an electronic circuit component. The variable portion 310 may be connected to the circuit connection portion 305, and a shape (or form) of the variable portion 310 may be deformed, unlike the vertical pin 16 in FIG. 8, when a PCB 525 (FIG. 15) is bent. The PCB connection portion 315 may be connected to the variable portion 310, and connected to the PCB 525. The variable portion 310 may have a rod structure that is relatively extendable in length, or a rod structure that includes a material that is extendable in length, so that the shape of the variable portion 310 may be deformed when the PCB 525 is bent. In more detail, the variable portion 310 may have a rod structure that is deformed in shape while a length (or shape) of the rod structure contracts or expands. As illustrated in FIG. 11, the circuit connection portion 305 and the PCB connection portion 315 may also have a rod structure.

The shape of the pin structure 300 may be formed by a mold. The pin structure 300 may be made of various types of metal having conductivity. For example, the metal may be copper, silver, or aluminum.

In a case in which the connector 515 is a vertical connector (or the pin structure 300 has a vertical pin structure), the variable portion 310 may have a rod structure with a serrated shape (or serrated form), as illustrated in FIG. 11.

Figure 12:
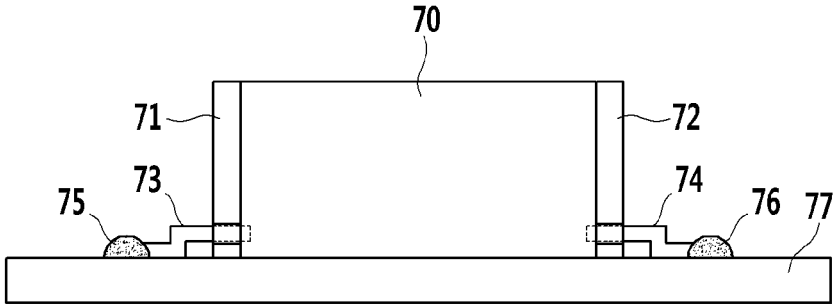
FIG. 12 is a view (longitudinal cross-sectional view) illustrating a connector having a horizontal pin structure.

FIG. 12 is a view (longitudinal cross-sectional view) illustrating a connector having a horizontal pin structure.

Referring to FIG. 12, the electronic circuit component has a circuit component 70 mounted on a PCB 77. The circuit component 70 is inserted into horizontal pin structures 73 and 74 that are attached to main bodies 71 and 72 of the connector, respectively, and connected to the PCB 77. Each of the horizontal pin structures 73 and 74 connects the circuit component 70 and the PCB 77 by solder 75 and 76. Each of the horizontal pin structures 73 and 74 has the same shape as the horizontal pin structure illustrated in FIG. 7. Therefore, the shape of each of the horizontal pin structures 73 and 74 is not deformed when the PCB 77 is bent.

Figure 13:
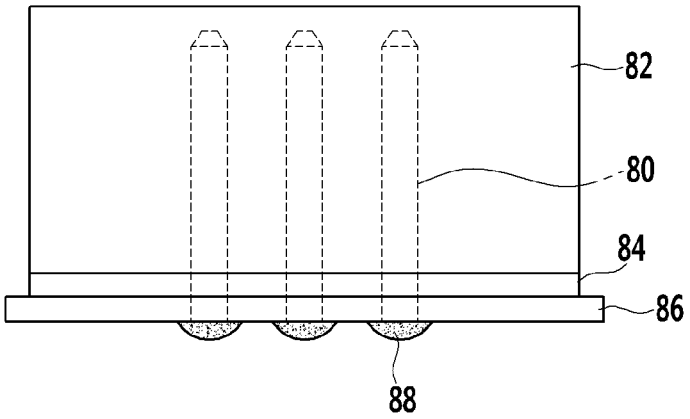
FIG. 13 is a view (longitudinal cross-sectional view) illustrating a connector having a vertical pin structure.

FIG. 13 is a view (longitudinal cross-sectional view) illustrating a connector having a vertical pin structure.

Referring to FIG. 13, a circuit component 82 is inserted into vertical pin structures 80 attached to a main body 84 of the connector, and connected to a PCB 86. Each of the vertical pin structures 80 connects the circuit component 82 and the PCB 86 by solder 88. Each of the vertical pin structures 80 has the same shape as the vertical pin structure illustrated in FIG. 8. Therefore, the shape of each of the horizontal pin structures 80 is not deformed when the PCB 86 is bent.

Figure 14:
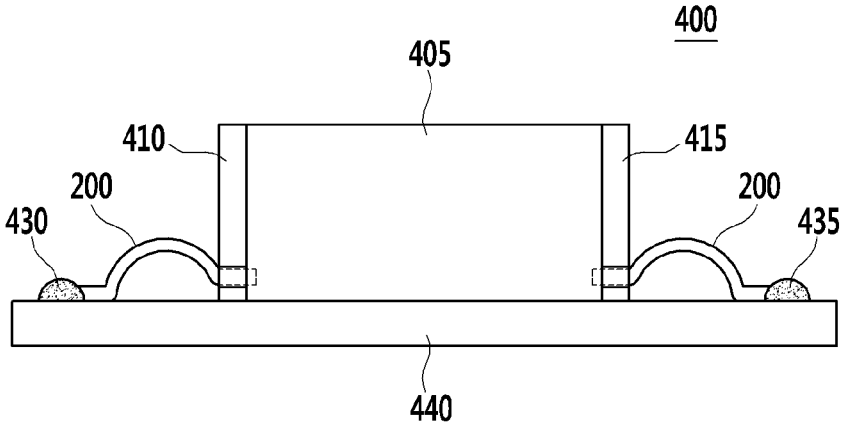
FIG. 14 is a view (longitudinal cross-sectional view) explaining a connector including a horizontal pin structure according to another exemplary embodiment.

FIG. 14 is a view (longitudinal cross-sectional view) explaining a connector including a horizontal pin structure according to another exemplary embodiment.

Referring to FIG. 14, an electronic device (or electronic component) 400 may include a circuit component 405 mounted on a PCB 440, connectors, connection members 430 and 435, such as solder, and a PCB 440. Each of the connectors may include at least one pin structure 200 that has been described with reference to FIG. 10. Each of the connectors may be applied to (and used for) electronic products such as a curved display device having a curved or flexible product structure. The pin structure 200 may be connected to a circuit pattern on the PCB 440 by the connection members 430 and 435.

Each of the connectors connected to the PCB 440 may include a connector body 410 or 415, and at least one pin 200 that is inserted into a through hole formed at a side of the connector body 410 or 415.

Figure 16:
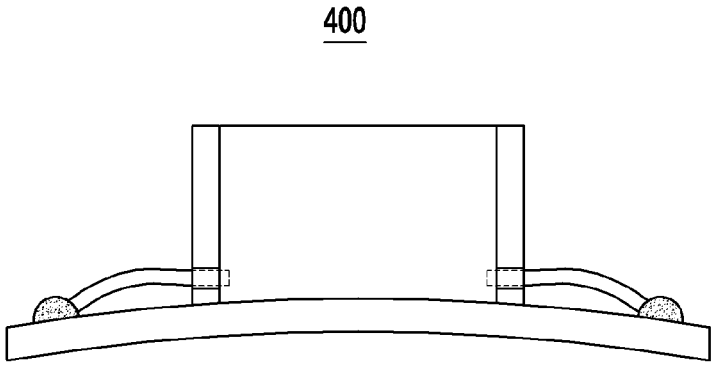
FIG. 16 is a view (longitudinal cross-sectional view) illustrating a state in which an electronic device illustrated in FIG. 14 is bent.

Each of the pins 200 may include a circuit connection portion that is inserted into each of the through holes and connected to the circuit component 405, a variable portion that is connected to the circuit connection portion and deforms in shape when the PCB 440 is bent, and a PCB connection portion that is connected to the variable portion and connected to the PCB 440. As illustrated in FIG. 14, the variable portion may have a rod structure with a curved line shape. Therefore, in the connector according to the present system and method, when the PCB 440 is bent as illustrated in FIG. 16, the shape of the pin structure 200 may be deformed, unlike the horizontal pins 73 and 74 in FIG. 12, thereby preventing a solder crack from occurring in the solder 430 and 435.

FIG. 15 is a view (longitudinal cross-sectional view) explaining a connector including a vertical pin structure according to another exemplary embodiment.

Referring to FIG. 15, an electronic device (or electronic component) 500 may include the circuit component 510, a connector, connection members 530, such as solder, and the PCB 525. The connector may include at least one pin structure 300 that has been described with reference to FIG. 11. The connector may be applied to (and used for) electronic products such as a curved display device having a curved or flexible product structure. The pin structures 300 may be connected to circuit patterns beneath the PCB 525 by the connection members 530.

The connector connected to the PCB 525 may include a connector body 515, the pins 300, which are inserted into through holes formed at a lower side of the connector body 515, and a space providing portion 520 formed (or disposed) between the connector body 515 and the PCB 525.

Each of the pins 300 may include a circuit connection portion that is inserted into each of the through holes and connected to the circuit component 510, a variable portion that is connected to the circuit connection portion and deforms in shape when the PCB 525 is bent, and a PCB connection portion that is connected to the variable portion and connected to the PCB 525. The space providing portion 520 may provide a space in which the variable portion is disposed and in which the variable portion may deform in shape. The space providing portion 520 may be formed by using a plastic mold. In another exemplary embodiment, the space providing portion 520 may form an opening between the connector body 515 and the PCB 525.

The aforementioned connector according to the present system and method includes the plurality of pins 300, but the present system and method may also be applied to the configuration having a single pin 300.

Figure 17:
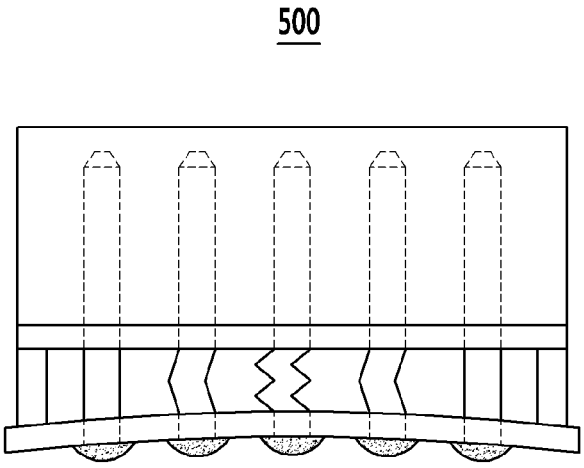
FIG. 17 is a view (longitudinal cross-sectional view) illustrating a state in which an electronic device illustrated in FIG. 15 is bent.

In the connector according to the present system and method, when the PCB 525 is bent as illustrated in FIG. 17, the shape of the pin structure 300, which is disposed at an edge of the connector among the pin structures 300, may be deformed, unlike the vertical pin 80 in FIG. 13, thereby preventing a solder crack from occurring in the solder 530, and preventing a contact defect of the connector.

Figure 18:
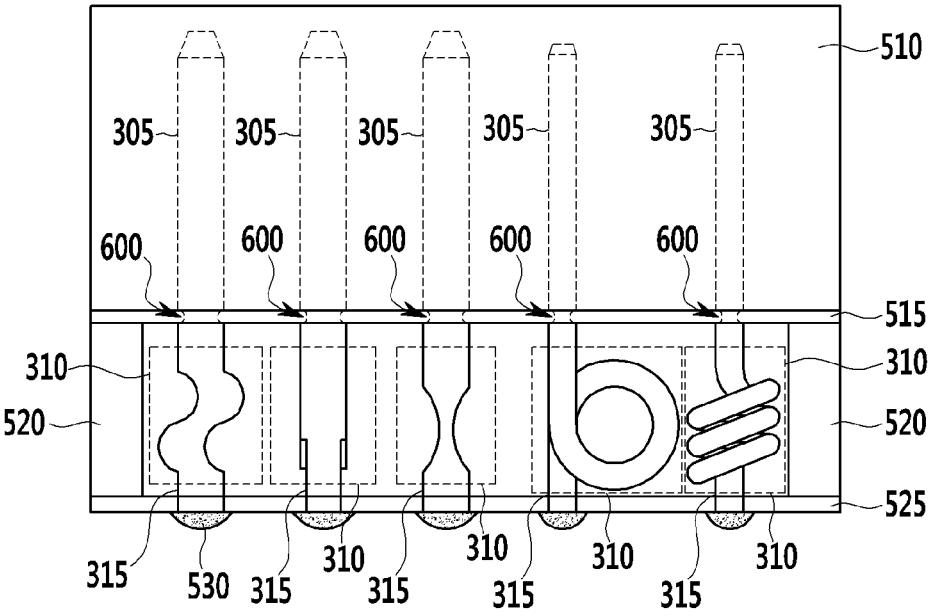
FIG. 18 is a view (longitudinal cross-sectional view) explaining a connector including the vertical pin structure according to another exemplary embodiment.

FIG. 18 is a view (longitudinal cross-sectional view) explaining the connector including the vertical pin structure according to another exemplary embodiment.

Referring to FIGS. 18, 11 and 15, the vertical pin structure, which has been described with reference to FIG. 15, may further include a locking unit 600 at the circuit connection portion 305.

The locking unit 600 may be a locking structure that prevents the circuit connection portion 305 from being deformed in length when the PCB 525 is bent, and has a locking shape.

In a case in which the circuit connection portion 305 has a rod shape, the locking unit 600 may be a rod portion that is formed at a lower side of the circuit connection portion 305 and has a cross section that has a circumferential length shorter than a circumferential length of a cross section of an upper portion of the circuit connection portion 305. In another exemplary embodiment, the locking unit 600 may be a rod portion having concave grooves formed at both lower ends of the circuit connection portion 305.

In a case in which the circuit connection portion 305 further includes the locking unit 600 that prevents the circuit connection portion 305 from being deformed in length when the PCB 525 is bent, the locking unit 600 may be inserted into (or fixed to) the through hole formed in the connector 515.

In a case in which the connector 515 is a vertical connector (or the pin structure has a vertical pin structure), the variable portion 310 may have a rod structure with an antenna shape (or antenna structure) or a spring shape (or spring structure), as illustrated in FIG. 18. The circuit connection portion 305 and the PCB connection portion 315 may also have the rod structure as illustrated in FIG. 18.

The antenna shape indicates three shapes illustrated at the left side of FIG. 18, and the spring shape indicates two shapes illustrated at the right side of FIG. 18.

Among the antenna shapes, the second variable portion 310 from the left may have a structure that extends in length (is lengthened) and is deformed in shape when the PCB 525 is bent such that a lower structure of the variable portion 310 is moved away from an upper structure of the variable portion 310. Among the antenna shapes, the third variable portion 310 from the left may have a structure in which an intermediate structure of the variable portion 310 extends in length (is lengthened) and is deformed in shape when the PCB 525 is bent.

The connector 515 according to the exemplary embodiment of FIG. 18 may include a combination of the vertical pin structure having the antenna shape and the pin structure having the spring shape.

Figure 19:
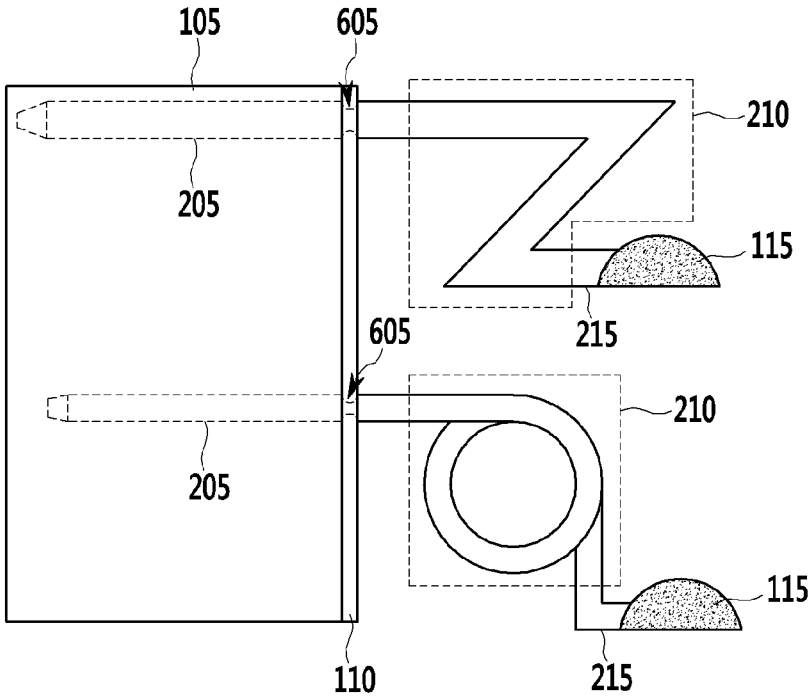
FIG. 19 is a view (longitudinal cross-sectional view) explaining a connector including the horizontal pin structure according to another exemplary embodiment.

FIG. 19 is a view (longitudinal cross-sectional view) explaining the connector including the horizontal pin structure according to another exemplary embodiment. A connector illustrated at the upper side of FIG. 19 and a connector illustrated at the lower side of FIG. 19 may be separated from each other.

Referring to FIGS. 19, 9 and 10, the horizontal pin structure, which has been described with reference to FIG. 9, may further include a locking unit 605 at the circuit connection portion 205.

The locking unit 605 may be a locking structure that prevents the circuit connection portion 205 from being deformed in length when the PCB 120 is bent.

In a case in which the circuit connection portion 205 has a rod shape, the locking unit 605 may be a rod portion that is formed at a lower side of the circuit connection portion 205 and has a cross section that has a circumferential length shorter than a circumferential length of a cross section of an upper portion of the circuit connection portion 205. In another exemplary embodiment, the locking unit 605 may be a rod portion having concave grooves formed at both lower ends of the circuit connection portion 205.

In a case in which the circuit connection portion 205 further includes the locking unit 605 that prevents the circuit connection portion 205 from being deformed in length when the PCB 120 is bent, the locking unit 605 may be inserted into (or fixed to) the through hole formed in the connector 110.

In a case in which the connector 110 is a horizontal connector (or the pin structure has a horizontal pin structure), the variable portion 210 may have a rod structure with a zigzag shape (a bent "Z" shape or the number "2" shape) or a spring shape (any one of a zigzag shape and a spring shape) when viewed in the front direction. The circuit connection portion 205 and the PCB connection portion 215 may also have the rod structure as illustrated in FIG. 19.

As described above, the present system and method include the pin structure that is deformable in shape, thereby reducing stress applied to the solder when the PCB is bent, and uniformly maintaining the arrangement of the pins of the connector. Therefore, the present system and method may improve reliability of the solder (or the circuit components) and contact reliability of the connector.

Figure 20:
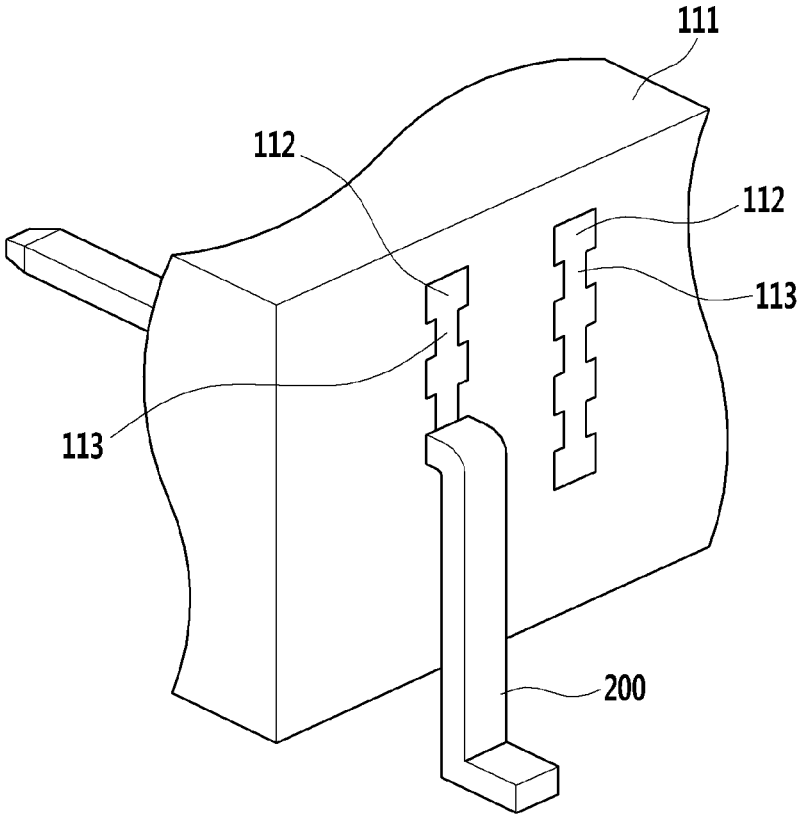
FIG. 20 is a view (perspective view) explaining a connector including the horizontal pin structure according to another exemplary embodiment.

FIG. 20 is a view (perspective view) explaining the connector including the horizontal pin structure according to another exemplary embodiment.

Referring to FIG. 20, an electronic device (or electronic component) may include a circuit component (not illustrated) that is mounted on a PCB (not illustrated), a connector 111 that is formed (or disposed) on the PCB, and a connection member (not illustrated) (e.g., solder) that connects the connector 111 and the PCB. The connector may include at least one pin structure 200 that has been described with reference to FIG. 9. In another exemplary embodiment, the connector may include at least one horizontal pin structure 64 illustrated in FIG. 7.

The electronic device illustrated in FIG. 20 may differ from the electronic device in FIG. 9 in that the pin structure 200 may move between insertion holes (or through holes) 112 formed at a side of the connector when the PCB is bent. In more detail, the electronic device in FIG. 20 may include the constituent elements of the aforementioned electronic device illustrated in FIG. 9, and the insertion holes 112 and connecting holes 113 that are formed at a side of the connector.

For example, a pair of groups of the insertion holes, which are arranged in parallel, is illustrated in FIG. 20. One group of the insertion holes may include four insertion holes 112. As illustrated in FIG. 20, the pin 200 may be inserted into (or fixed to) one insertion hole 112.

The connector may be applied to (and used for) electronic products such as a curved display device having a curved or flexible product structure. The pin structure 200 may be connected to a circuit pattern on the PCB by the connection member.

The connector connected to the PCB may include a connector body 111, the pin 200, which is inserted into any one of at least two insertion holes 112 formed at a side of the connector body 111, and the connecting holes 113, which allow the pin 200 to move between the insertion holes 112 (for example, downward) when the PCB is bent and connect the insertion holes 112. The connecting hole may be a through hole. When a predetermined amount or more of stress is applied to the pin 200, a position of the pin 200 may be moved (or changed).

The pin 200 may include a circuit connection portion that is inserted into any one of the insertion holes 112 and connected to the circuit component, a variable portion that is connected to the circuit connection portion and deforms in shape when the PCB is bent (curved), and a PCB connection portion that is connected to the variable portion and connected to the PCB.

The variable portion may have a rod structure that deforms in shape while a length (or shape) of the rod structure contracts or expands. The variable portion may have a rod structure with a zigzag shape or a spring shape.

The aforementioned present system and method may also be applied to an exemplary embodiment in which the pin is deformed in shape or the pin is changed in position from an initial state according to a radius of curvature of a curved display device.

Although the discussion above expounds on an exemplary embodiment in which the pin structure is included in the connector, according to another exemplary embodiment, a pin structure that is directly connected to a circuit component may also be applied. Except for the configuration in which the pin structure is not included in the connector, the pin structure according such an embodiment may include the same constituent elements as the aforementioned exemplary pin structures (e.g., pin structure in FIG. 9).

As described above, exemplary embodiments are disclosed in the drawings and the specification. Here, although specific terms have been used, the terms are used for the purpose of describing the present system and method, and do not limit the meaning or the scope of the present system and method, which is included in the appended claims. Thus, those of ordinary skill in the art would appreciate that numerous variations and equivalent exemplary embodiments may be made from the present system and method. Accordingly, the technical protection scope of the present system and method is determined by the technical spirit of the appended claims.

DESCRIPTION OF SYMBOLS

105: Circuit component
110: Connector
115: Connection member
120: PCB
205: Circuit connection portion
210: Variable portion
215: PCB connection portion
305: Circuit connection portion
310: Variable portion
315: PCB connection portion

What is claimed is:

1. A pin structure that is connected to a printed circuit board (PCB), the pin structure comprising:
- a circuit connection portion inserted into a through hole and connected to a circuit component;
- a variable portion connected to the circuit connection portion and configured to deform in shape when the PCB is bent; and
- a PCB connection portion connected to the variable portion and connected to the PCB,
- wherein the variable portion has a rod structure that is configured to deform in shape, and
- the variable portion and the PCB connection portion do not insert into the through hole.

2. The pin structure of claim 1, wherein: the circuit connection portion further includes a locking unit that is configured to prevent the circuit connection portion from being deformed in length when the PCB is bent.

3. The pin structure of claim 2, wherein: the circuit connection portion has a rod shape, and the locking unit is a rod portion that is formed at a lower side of the circuit connection portion and has a cross section that has a circumferential length shorter than a circumferential length of a cross section of an upper portion of the circuit connection portion.

4. The pin structure of claim 1, wherein: the pin structure has a horizontal pin structure, and the variable portion has a zigzag shape or a spring shape.

5. The pin structure of claim 1, wherein: the pin structure has a vertical pin structure, and the variable portion has a serrated shape, an antenna shape, or a spring shape.

6. A connector that is connected to a printed circuit board (PCB), the connector comprising:
- a connector body;
- at least one pin inserted into a through hole formed at a lower side of the connector body; and
- a space providing portion formed between the connector body and the PCB, wherein the pin includes:
  - a circuit connection portion inserted into the through hole and connected to a circuit component;
  - a variable portion connected to the circuit connection portion and configured to deform in shape when the PCB is bent; and
  - a PCB connection portion connected to the variable portion and connected to the PCB, and the space providing portion provides a space in which the variable portion is disposed,
  - wherein the variable portion has a rod structure that is configured to deform in shape, and
  - the variable portion and the PCB connection portion do not insert into the through hole.

7. The connector of claim 6, wherein: the circuit connection portion further includes a locking unit that prevents the circuit connection portion from being deformed in length when the PCB is bent, and the locking unit is inserted into the through hole.

8. The connector of claim 6, wherein: the variable portion has a serrated shape, an antenna shape, or a spring shape.

9. A connector that is connected to a printed circuit board (PCB), the connector comprising:
- a connector body; and
- at least one pin inserted into a through hole formed at a side of the connector body, wherein the pin includes:
  - a circuit connection portion inserted into the through hole and connected to a circuit component;

a variable portion connected to the circuit connection portion and configured to deform in shape when the PCB is bent; and a PCB connection portion connected to the variable portion and connected to the PCB, wherein the variable portion has a rod structure that is configured deformed in shape, and the variable portion and the PCB connection portion do not insert into the through hole.

10. The connector of claim 9, wherein: the circuit connection portion further includes a locking unit that prevents the circuit connection portion from being deformed in length when the PCB is bent, and the locking unit is inserted into the through hole.

11. The connector of claim 9, wherein: the variable portion has a zigzag shape or a spring shape.

12. A connector that is connected to a printed circuit board (PCB), the connector comprising:

a connector body;

a pin inserted into any one of at least two insertion holes formed at a side of the connector body; and a connecting hole that is configured to allow the pin to move between the at least two insertion holes when the PCB is bent, and connects the insertion holes.

13. The connector of claim 12, wherein: the pin includes: a circuit connection portion inserted into any one of the insertion holes and connected to a circuit component; a variable portion connected to the circuit connection portion and configured to deform in shape when the PCB is bent; and a PCB connection portion connected to the variable portion and connected to the PCB.

14. The connector of claim 13, wherein: the variable portion has a rod structure that is configured to deform in shape.

* * * * *